US009224254B2

(12) United States Patent
Kuga

(10) Patent No.: US 9,224,254 B2
(45) Date of Patent: Dec. 29, 2015

(54) DISPLAY APPARATUS

(71) Applicant: NHK SPRING CO., LTD., Yokohama-shi, Kanagawa (JP)

(72) Inventor: Masayuki Kuga, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 261 days.

(21) Appl. No.: 13/872,814

(22) Filed: Apr. 29, 2013

(65) Prior Publication Data

US 2013/0300588 A1 Nov. 14, 2013

(30) Foreign Application Priority Data

May 1, 2012 (JP) ..... 2012-104629

(51) Int. Cl.

| | |
|---|---|
| ***G08B 21/00*** | (2006.01) |
| ***B63H 25/36*** | (2006.01) |
| ***G07C 5/08*** | (2006.01) |
| *B63H 25/52* | (2006.01) |
| *F02D 11/10* | (2006.01) |
| *B63H 25/24* | (2006.01) |
| *B63H 25/02* | (2006.01) |

(52) U.S. Cl.

CPC ..... *G07C 5/0816* (2013.01); *B63H 25/24* (2013.01); *B63H 25/52* (2013.01); *B63H 2025/028* (2013.01); *F02D 2011/108* (2013.01)

(58) Field of Classification Search

CPC ..... F02D 11/106; F02D 41/2432; F02D 41/2464; B63H 21/213; B63H 20/00; B63H 2020/003; B63H 2021/216; B63H 21/21; B63H 25/36; B60R 25/018; B60R 25/252; B60R 25/257; B60R 25/33; B60R 25/102

USPC ..... 340/984, 985, 539.13, 384.7; 701/21, 701/206, 213; 440/6, 1, 3, 84; 180/55.21, 180/65.24, 65.29; 320/104, 119–121; 715/771

See application file for complete search history.

(56) References Cited

U.S. PATENT DOCUMENTS

| | | | | |
|---|---|---|---|---|
| 6,273,771 | B1 * | 8/2001 | Buckley et al. | 440/84 |
| 7,143,363 | B1 * | 11/2006 | Gaynor et al. | 715/771 |
| 7,330,133 | B2 | 2/2008 | Kawanishi et al. | |
| 8,836,544 | B1 * | 9/2014 | Balogh | 340/984 |
| 2008/0015746 | A1 * | 1/2008 | Bertazzoni | 701/21 |
| 2009/0156068 | A1 * | 6/2009 | Barrett et al. | 440/3 |
| 2009/0187297 | A1 * | 7/2009 | Kish et al. | 701/21 |
| 2009/0222155 | A1 * | 9/2009 | Alston et al. | 701/21 |
| 2011/0104962 | A1 * | 5/2011 | Krause et al. | 440/2 |

FOREIGN PATENT DOCUMENTS

| | | |
|---|---|---|
| JP | 2005-164743 A | 6/2005 |

* cited by examiner

*Primary Examiner* — Fekadeselassie Girma
*Assistant Examiner* — Mancil Littlejohn, Jr.
(74) *Attorney, Agent, or Firm* — Holtz, Holtz, Goodman & Chick PC

(57) ABSTRACT

An apparatus comprises a display, a communication device, and a controller. The communication device performs communication with a remote control system. The system comprises a control head, a shift actuator, and a throttle actuator. The head designates a shift position and a throttle opening. The shift actuator drives a shift mechanism in accordance with the shift position. The throttle actuator drives the throttle mechanism in accordance with the throttle opening. The communication device receives at least one of the shift position, the throttle opening and ID data of malfunction in the system. The controller causes the display to display the shift position, the throttle opening, or the type or cause of the malfunction.

16 Claims, 10 Drawing Sheets

36a

Setting file for the electronic steering system

| Item | Setting value |
|---|---|
| Steering wheel friction | ••••• |
| Lock to Lock steering rotations | ••••• |
| Steering backlash | ••••• |
| Rudder angle/wheel position | ••••• |
| Toe-in/toe-out | ••••• |
| Ackerman operation | ••••• |
| Steering-actuator stroke | ••••• |
| | |
| | |

FIG. 2

46a

Setting file for the electronic remote control system

| Item | Setting value |
|---|---|
| Shift mode | ••••• |
| Shift forward stroke | ••••• |
| Shift reverse stroke | ••••• |
| Throttle mode | ••••• |
| Throttle forward stroke | ••••• |
| Throttle reverse stroke | ••••• |
| Synchronization configuration | ••••• |
| Forward throttle opening | ••••• |
| Reverse throttle opening | ••••• |
| Throttle delay | ••••• |
| Shift pause | ••••• |
| Engine setting | ••••• |
| Setting active/inactive | ••••• |
| | |
| | |

FIG. 3

102a

Error type file

| Code | Item | Cause | Buzzer pattern |
|---|---|---|---|
| C001 | Helm sensor error | ····· | ····· |
| C002 | Actuator sensor error | ····· | ····· |
| C003 | Actuator-motor hall sensor error | ····· | ····· |
| C004 | Actuator overload | ····· | ····· |
| C005 | SW error | ····· | ····· |
| C006 | Steering-system com.error | ····· | ····· |
| C007 | Shift actuator error | ····· | ····· |
| C008 | Throttle actuator error | ····· | ····· |
| C009 | Control head error | ····· | ····· |
| C010 | Power supply error | ····· | ····· |
| C011 | Remote-control system com.error | ····· | ····· |
| | | | |
| | | | |

FIG. 5

DISPLAY APPARATUS

CROSS-REFERENCE TO RELATED APPLICATIONS

This application is based upon and claims the benefit of priority from the prior Japanese Patent Application No. 2012-104629, filed May 1, 2012, the entire contents of which are incorporated herein by reference.

BACKGROUND OF THE INVENTION

1. Field of the Invention

The present invention relates to a display apparatus for use in vessels.

2. Description of the Related Technology

Apparatuses are known, each designed for used in vessels and configured to receive various data from the electronic control unit (ECU) mounted on the engine unit or from an external apparatus connected to it, and to display the data so received. The external apparatus is, for example, a radar or a global positioning system (GPS) terminal. The data is, for example, the GPS data, radar data, data about the operating state of the engine, or data about various malfunctions with the engine, etc.

JP-A-2005-164743, for example, discloses a display apparatus that displays various data such as the oil pressure in the engine, the temperature of the engine cooling water and the rotational speed of the engine.

In recent years, some vessels have an electronic steering system or an electronic remote-control system. The electronic steering system is a system comprising a sensor installed in the helm apparatus and configured to detect the angle by which the helm has been rotated. In accordance with the electric signal output from a sensor, the electronic steering system drives an electrically-driven actuator, i.e., the steering drive source. The electronic remote-control system comprises a control head having a lever and a sensor. The sensor detects the angle by which the lever has been rotated. In accordance with the electric signal output from this sensor, the electronic remote-control system drives an electrically-driven actuator, i.e., the drive source for the shift arm and throttle arm of the engine.

Using the display apparatus disclosed in JP-A-2005-164743, the user (i.e., helmsman or operator) can indeed know the operating state of the engine. However, the user cannot know the operating state of the electronic steering system or the electronic remote-control system.

Assume that the electronic steering system, the electronic remote-control system or the outboard engine unit encounters a malfunction. Then, a lamp flickers or a buzzer generates sound in a specific pattern, informing the user of the system the error and the type of the error. If so informed of the error, the user can not easily determine the type or cause of the trouble, without referring to the manual or the like.

Also assume that the electronic steering system or the electronic remote-control system is installed in the hull. In this case, the DIP switch on the control unit of the system must be used to preset the direction and stroke, etc. in and by which the actuator should be operated in accordance with the output of the sensor. To preset these data, the operator needs to move to the control unit of each device and to perform various works, such as changing over the DIP switch.

If the helm apparatus or the control head fails to operate or is damaged broken by some cause, the vessel can no longer be steered.

Thus, any vessel having an electronic steering system or an electronic remote-control system has various imperfections concerning steering and settings, which should be solved.

BRIEF SUMMARY OF THE INVENTION

Accordingly, an object of this invention is to increase the operability of any vessel that has an electronic steering system or an electronic remote-control system and to enhance the setting efficiency in such a vessel.

A display apparatus according one aspect of this invention is designed for use in vessels. The display apparatus comprises a display, a communication device, and a controller. The communication device performs communication with a remote control system. The remote control system comprises a control head, a shift actuator, and a throttle actuator. The control head designates the shift position of the shift mechanism of the propulsion device provided in the vessel, and designates also the throttle opening of the throttle mechanism of the propulsion device. The shift actuator drives the shift mechanism in accordance with the shift position designated by the control head. The throttle actuator drives the throttle mechanism in accordance with the throttle opening designated by the control head. While communicating with the remote control system, the communication device receives at least one data message selected from the shift position designated by the control head, the throttle opening designated by the control head and the ID data indicating malfunction in the remote control system. The controller causes the display to display the shift position the communication device has received, the throttle opening the communication device has received, or the type of the malfunction or the cause of the malfunction indicated by the ID data.

In the other embodiment of this invention, the display apparatus further comprises an interface which is, for example, a touch panel that the user may operate to manipulate the display. The controller causes the display to display a setting screen on which the user may designate setting values for operating the remote control system. The controller further communicates with the remote control system through the communication device, and changes the setting of the remote control in accordance with the setting values designated on the setting screen by the user.

In still another embodiment, a malfunction may occur in the control head. In this case, the controller causes the display to display an emergency screen, on which the user may designate the shift position and the throttle opening. Further, the controller communicates with the remote control system through the communication device, driving the shift actuator and the throttle actuator in accordance with, respectively, the shift position and the throttle opening both designated on the emergency screen by the user.

A display apparatus according to another aspect of this invention is designed for use in vessel and comprises a display, a communication device, and a controller. This display apparatus communicates with a steering system. The steering system includes a helm apparatus and a steering actuator. The helm apparatus designates the rudder angle for the propulsion device provided in the vessel. The steering actuator drives a steering mechanism configured to change the rudder angle of the propulsion device, in accordance with the rudder angle the helm apparatus has designated. While communicating with the steering system, the communication device receives at least one data message selected from the rudder angle designated by the helm apparatus and the ID data indicating any malfunction in the steering system. The controller causes the display to display the rudder angle received by the communication device or the type or cause of the malfunction, represented by the ID data.

In the other embodiment of this invention, the display apparatus further comprises an interface which is, for example, a touch panel that the user may operate to manipulate the display. The controller causes the display to display a setting screen on which the user may designate setting values for operating the steering system. The controller further communicates with the steering system through the communication device, and changes the setting of the steering system in accordance with the setting values designated on the setting screen by the user.

In still another embodiment, a malfunction may occur in the helm apparatus. In this case, the controller causes the display to display an emergency screen, on which the user may designate a rudder angle. Further, the controller communicates with the steering control system through the communication device, driving the steering actuator in accordance with the rudder angle designated on the emergency screen by the user.

The components of the display apparatus according to each embodiment can be combined, if arbitrarily, with those of any other embodiment.

This invention can enhance the operability of any vessel that has an electronic steering system or an electronic remote-control system, and the setting efficiency in the vessel. Therefore, the user can quite easily know, for example, the operating state of the electronic steering system or electronic remote-control system and the type ad cause of any malfunction occurring in the system. Further, the user can quite easily implement various settings of the operation of the electronic steering system or electronic remote-control system. Still further, the user can use the display apparatus to steer the vessel, even if a malfunction occurs in the electronic steering system or electronic remote-control system.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 2 is a diagram showing an exemplary data structure of the setting file for the electronic steering system provided in the vessel;

FIG. 3 is a diagram showing an exemplary data structure of the setting file for the electronic remote control system provided in the vessel;

FIG. 5 is a diagram showing an exemplary data structure of the error code file stored in the memory of the display apparatus;

DETAILED DESCRIPTION OF THE INVENTION

A configuration of this invention will be described with reference to the accompanying drawings. The configuration is a display apparatus for use in a small vessel equipped with one outboard engine unit used as propulsion device that generate a propulsion force.

Figure 1:
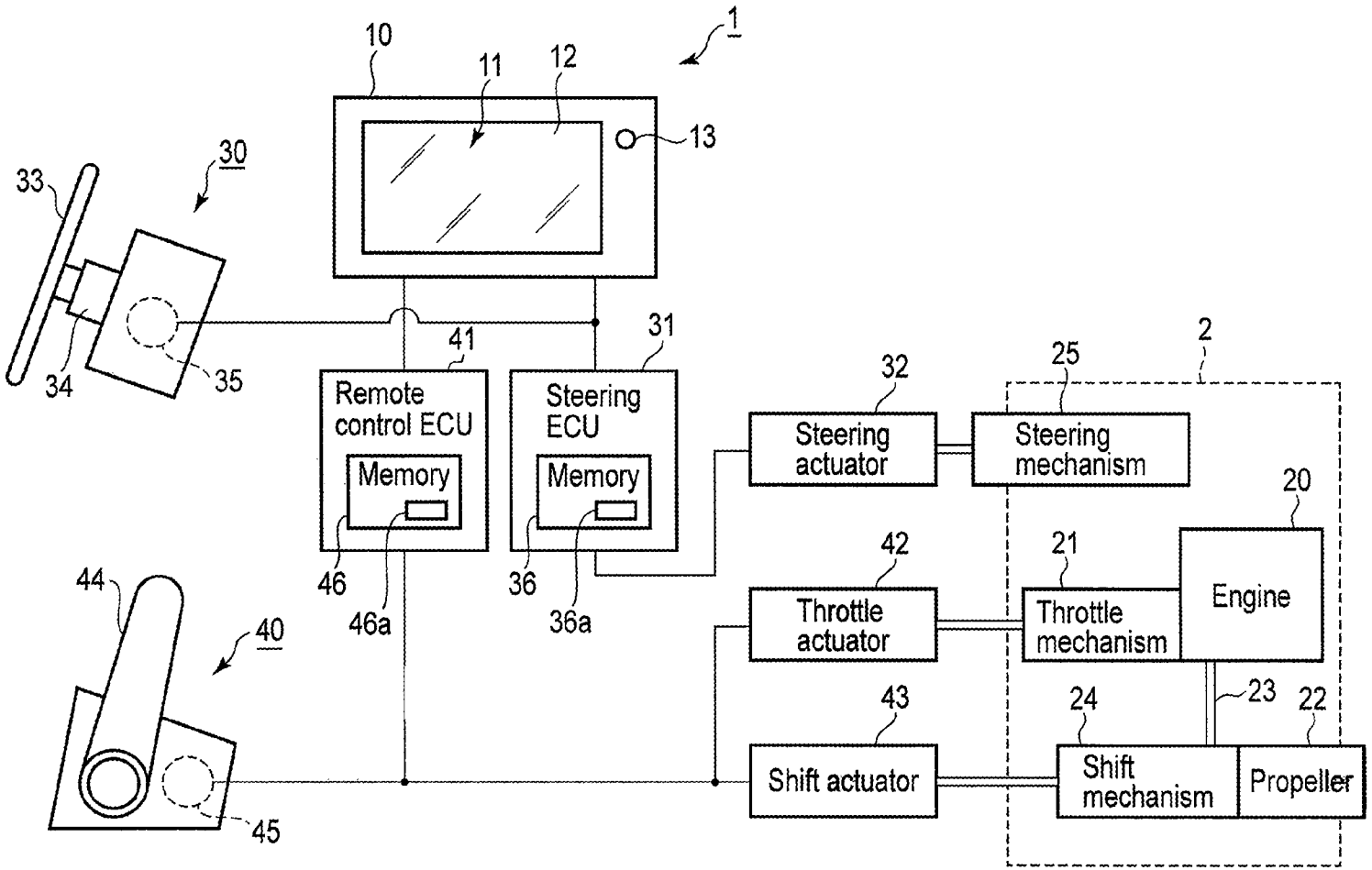
FIG. 1 is a block diagram showing the electrical components of one embodiment, which are provided in a vessel.

FIG. 1 is a block diagram showing some of the electrical components provided in the vessel. The vessel has a display apparatus 1, an outboard engine unit 2, an electronic steering system, and an electronic remote control system.

The display apparatus 1 includes a housing 10, a liquid crystal display (LCD) 11, a touch panel 12, and a power switch 13. The LCD 11 is provided on the housing 10. The touch panel 12 is provided on the display screen of the LCD 11. The power switch 13 is arranged on the housing 10. The touch panel 12 can be any type available, such as resistive type, capacitance type or optical type. Nonetheless, it is desirable that the touch panel 12 be a pressure type (e.g., resistive type), because the user may touch it with the gloved fingers and seawater, which is electrically conductive and may stick to it.

The outboard engine unit 2 comprises an engine 20, a throttle mechanism 21, a propeller 22, a drive shaft 23, and a shift mechanism 24. The engine 20 is the power source. The throttle mechanism 21 has a valve configured to adjust the rate at which the engine 20 intakes air. The propeller 22 is the propulsion force generator. The drive shaft 23 is rotated with the force generated by the engine 20. The shift mechanism 24 comprises a plurality of gears, which transmit the rotation of the drive shaft to the shaft of the propeller 22.

The outboard engine unit 2 is secured to the stern plate of the hull by a steering mechanism 25. The steering mechanism 25 includes a bracket and a steering arm. The bracket holds the outboard engine unit 2 to, for example, the stern plate, enabling to rotate the unit 2 towards starboard or port via the helm. The steering arm is secured to the outboard engine unit 2.

The electronic steering system includes a helm apparatus 30, a steering ECU 31, and a steering actuator 32. The steering ECU 31 functions as controller in the electronic steering system. The steering actuator 32 is coupled to the steering arm of the steering mechanism 25.

If the steering actuator 32 is driven, its force moves the steering arm of the steering mechanism 25 in the starboard or port direction. The helm apparatus 30 includes a steering wheel 33, a friction mechanism 34 and a helm sensor 35. The steering wheel 33 may be rotated to steer the vessel. The friction mechanism 34 has a variable control mechanism configured to change the force (friction force) resistant to the rotation of the steering wheel 33. The helm sensor 35 outputs a signal representing the angle by which the steering wheel 33 has been rotated.

The steering ECU 31 is connected by a dedicated communication line to the steering wheel 30, the steering actuator 32, etc. Through the communication line, various types of communication can be achieved, such as controller area network (CAN) communication, local interconnect network (LIN) communication and RS232 communication. The steering ECU 31 comprises a memory 36, which stores a setting file 36*a*. The setting file 36*a* holds parameters, which the steering ECU 31 uses to control in the electronic steering system.

FIG. 2 shows an exemplary data structure of the setting file 36*a*. The setting file 36*a* has a data structure, in which values are allocated to various setting items, respectively. The setting items include, for example, "steering wheel friction", "lock to lock rotations", "steering backlash", "rudder angle/wheel position", "toe-in/toe-out", "Ackerman operation" and "steering-actuator stroke". The "steering wheel friction" indicates the resistance the friction mechanism 34 should set. The "lock to lock rotations" indicates the number of times the steering wheel must be turned to rotate the outboard engine unit 2 from the neutral position by maximum clockwise to the maximum counter clockwise. The "steering backlash" indicates the angle by which the steering wheel 33 may be turned without driving the steering actuator 32. The "rudder angle/wheel position" indicates the relation between the angle by which the steering wheel 33 has been turned and the angle by which the rudder has been turned thereby. The "toe-in/toe-out" indicates the toe angle for the vessel in the case where the vessel has a plurality of outboard engine units. The "Ackerman operation" indicates the difference in rudder angle between outboard engine units the vessel may have. The "steering-actuator stroke" indicates the operating stroke of the steering actuator 32.

The steering ECU 31 performs various controls on the electronic steering system in accordance with the setting values written in the setting file 36*a*. For example, the steering ECU 31 controls the friction mechanism 34 so that the resistance to the steering wheel 33 may have the value set for the "steering wheel friction". The steering ECU 31 further determines a desirable rudder angle from the signal output from the helm sensor 35 and the value set for the "rudder angle/wheel position." Then, the steering ECU 31 drives the steering actuator 32 by the angle that accords with both the rudder angle thus determined and the value set for the "steering-actuator stroke."

The electronic remote-control system includes a control head 40, a remote control ECU 41, a throttle actuator 42, and a shift actuator 43. The remote control ECU 41 functions as controller in the electronic remote-control system. The throttle actuator 42 is coupled to the throttle mechanism 21 by a push-pull cable. The shift actuator 43 is coupled to the shift mechanism 24 by a push-pull cable.

If the throttle actuator 42 is driven, its force is transmitted to the throttle mechanism 21 via the push-pull cable coupled to the throttle mechanism 21, changing the opening of the valve of the throttle mechanism 21. The opening of the valve shall hereinafter be called "throttle opening". If the shift actuator 43 is driven, its force is transmitted to the shift mechanism 24 via the push-pull cable coupled to the shift mechanism 24, switching the shift position of the shift mechanism 24 to, for example, the forward position, neutral position or the backward position.

The control head 40 includes a lever 44 and a lever sensor 45. The lever 44 may be manipulated to perform a throttle operation and a shift operation in the outboard engine unit 2. The lever sensor 45 outputs a signal that accords with the inclination angle of the lever 44. For example, the position where the lever 44 is inclined forward from the neutral position by a prescribed angle is the forward shift-switching position, and the position where the lever 44 is inclined backward from the neutral position by a prescribed angle is the backward shift-switching position. In the angle range forward from the forward shift-switching position and backward from the backward shift-switching position, the lever 44 may be inclined by any angle to open the valve of the throttle mechanism 21 to the extent that accords with that angle.

The remote control ECU 41 is connected by dedicated communication lines to the control head 40, throttle actuator 42 and shift actuator 43. The communication achieved through these dedicated communication lines can be of any type available, such as CAN communication, LIN or RS232 communication. The memory 46 incorporated in the remote control ECU 41 stores a setting file 46*a*.

FIG. 3 shows the data structure of the setting file 46*a*. The setting file 46*a* is so constructed that setting values are allocated to various setting items, respectively. These setting items include, for example, "shift mode", "shift forward stroke", "shift reverse stroke", "throttle mode", "throttle forward stroke", "throttle reverse stroke", "synchro configuration", "forward throttle opening", "reverse throttle opening", "throttle delay", "shift pause", "engine setting", and "setting active/inactive". The "shift mode" indicates the push-pull polarity of the shift actuator 43. The push-pull polarity is the relation between the shift position and the driving direction of the push-pull cable. The "shift forward stroke" indicates the operating stroke that the shift actuator 43 must undergo to change the shift position of the shift mechanism 24 from the neutral to the forward. The "shift reverse stroke" indicates the operating stroke that the shift actuator 43 must undergo to change the shift position of the shift mechanism 24 from the neutral to the reverse. The "throttle mode" indicates the push-pull polarity of the throttle actuator 42. This push-pull polarity is the relation between the valve opening or closing of the throttle mechanism 21 and the driving direction of the push-pull cable. The "throttle forward stroke" indicates the operating stroke that the throttle actuator 42 undergoes if the shift position is forward. The "throttle reverse stroke" indicates the operating stroke that the throttle actuator 42 undergoes if the shift position is reverse. The "synchro configuration" indicates the on/off of the synchro mode in which outboard engines, if used, are synchronized in terms of rotational speed. The "forward throttle opening" indicates the throttle-opening characteristic of the throttle mechanism 21 if the shift position is forward. The "reverse throttle opening" indicates the throttle-opening characteristic of the throttle mechanism 21 if the shift position is reverse. The throttle-opening characteristic is either the first pattern for linearly changing the throttle opening in accordance with the inclination angle of the lever 44, or the second pattern for changing the throttle opening, along a curve, in accordance with the inclination angle of the lever 44. The "throttle delay" indicates the on/off of the buffering function of delaying the operation of the throttle actuator 42, more than usual, with respect to the inclination angle of the lever 44 rotated abruptly. The "shift pause" indicates the setting about the shift pose function of mitigating the operation performed if the lever 44 is abruptly rotated and the shift position is thereby changed from the forward or reverse position to the neutral position. The "engine setting" indicates the setting about the operating state of each engine if the vessel has a plurality of outboard engine units. The "setting active/inactive" indicates whether the electronic remote-control system should be operated in accordance with the setting values written in the setting file 46*a* (setting effective), or in accordance with the default setting values written in the setting file 46*a* (setting ineffective).

The remote control ECU 41 controls various functions in the electronic remote-control system, in accordance with the setting values written in the setting file 46*a*. If the lever 44, for example, is inclined from the neutral position to the forward shift-switching position, the remote control ECU 41 drives the shift actuator 43 by the operating stroke of the setting value for "shift forward stroke" in the direction associated with the push-pull polarity indicated by the setting value for "shift mode", thereby switching the shift mechanism 24 to the forward side. If the lever 44 is further inclined from the forward shift-switching position, the remote control ECU 41 drives the throttle actuator 42 in the direction associated with that accords with the push-pull polarity indicated by "throttle mode", by the stroke that accords with the inclination angle represented by the signal output from the lever sensor 45 and the value set for "throttle forward stroke".

The display apparatus 1 will be described in detail.

Figure 4:
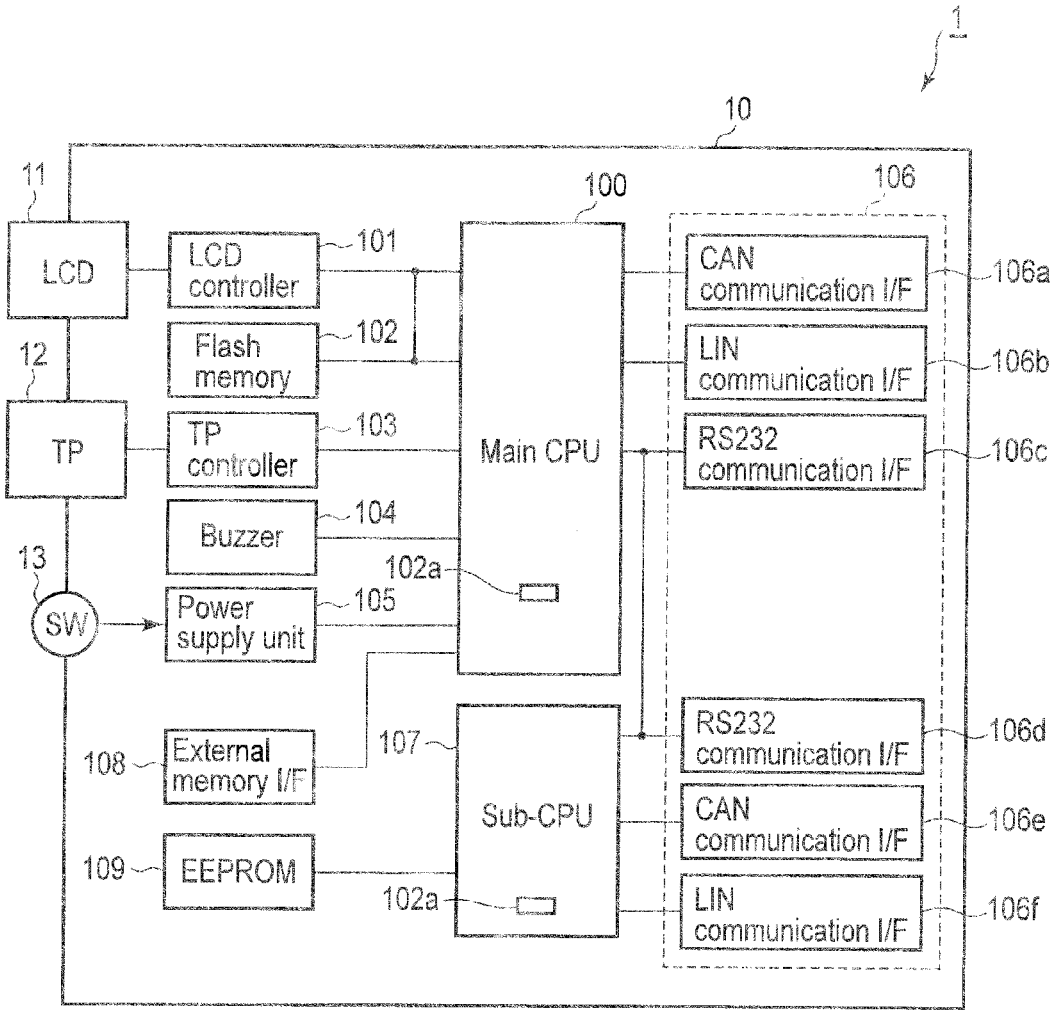
FIG. 4 is a block diagram showing the electrical components of the display apparatus provided in the vessel.

FIG. 4 is a block diagram showing the electrical components of the display apparatus 1. The display apparatus 1 comprises a main central processing unit (CPU) 100, an LCD controller 101 connected to the LCD 11, a flash memory 102, a touch panel (TP) controller 103 connected to the touch panel 12, a buzzer 104, a power supply unit 105, a communication device 106, a sub-CPU 107, an external memory I/F 108, and an electrically erasable programmable read-only memory (EEPROM) 109. The main CPU 100 and the sub-CPU 107 function as controllers that control the other components of the display apparatus 1.

The LCD controller 101, the flash memory 102, the touch panel controller 103, the buzzer 104, the power supply unit 105, the communication device 106 and the external memory I/F 108 are connected to the main CPU 100 by a bus line composed of an address bus and a data bus. The EEPROM 109 is connected to the sub-CPU 107 by a bus line composed of an address bus and a data bus. The EEPROM 109 may be connected to the main CPU 100. Alternatively the EEPROM 109 may be incorporated in the main CPU 100 or the sub-CPU 107.

The LCD controller 101 controls the LCD 11. The flash memory 102 stores screen data that the LCD 11 will display. The touch panel controller 103 calculates the coordinates of an operating position on any screen displayed by the LCD 11, from the signal generated by the touch panel 12 at a touched part thereof. The touch panel controller 103 outputs the coordinates, thus calculated, to the main CPU 100. The main CPU 100 can therefore detect any operation of the graphical user interface (GUI) included in the screen displayed on the LCD 11. Note that the touch panel controller 103 may be one configured to output, to the main CPU 100, not the position at which the panel 12 has been touched, but a signal that accords with the position. In this case, the main CPU 100 needs only to calculate the position at which the panel 12 has been touched. Even with this configuration, the main CPU 100 can detect the operation of the GUI included in the screen displayed by on the LCD 11.

The buzzer 104 generates a beep of the pattern designated by the main CPU 100. The power supply unit 105 has, for example, a battery, and keeps supplying power from the battery to the other components of the display apparatus 1. The communication device 106 includes a CAN communication interface (I/F) 106*a*, a LIN communication I/F 106*b* and an RS232 communication I/F 106*c*, all connected to the main CPU 100. The communication device 106 further includes an RS232 communication I/F 106*d*, a CAN communication I/F 106*e*, and a LIN communication I/F 106*f*, all connected to the sub-CPU 107. The communication device 106 communicates with the communication units included in the steering ECU 31 and the communication units included in the remote control ECU 41, through all or some of these communication I/Fs 106*a* to 106*f*. The external memory I/F 108 is, for example, an universal serial bus (USB) memory or an SD card, and is connected to the main CPU 100.

The main CPU 100 has an internal read only memory (ROM), which stores a computer program. The main CPU 100 executes the computer program and performs various operations, turning on the backlight of the LCD 11 and adjusting the luminance of the LCD 11, and various operations onto the LCD 11 display screens. The sub-CPU 107 is connected to the main CPU 100 via RS232 communication I/Fs 106*c* and 106*d*. The sub-CPU 107 incorporates a ROM, which stores a computer program. The sub-CPU 107 executes the computer program, performing various operations including a process of displaying screens on the LCD 11. The sub-CPU 107 is used to achieve parallel processes with the main CPU 100.

The ROMs incorporated in the main CPU 100 and sub-CPU 107 store the error code file 102*a*, in addition to the computer programs. FIG. 5 shows an exemplary data structure of the error-type file 102*a*. The error code file 102*a* holds error codes allocated to the types of errors (in another word, malfunctions) that may occur in the electronic steering system, electronic remote-control system and the outboard engine unit 2. The error code file 102*a* also holds first text data, second text data and buzzer pattern data, which are associated with one another. The first text data represents the types of malfunctions (or positions of malfunctions). The second data represents the causes of these malfunctions. The buzzer pattern data represents the patterns in which the buzzer 104 generates alarms, describing the malfunctions.

As shown in FIG. 5, "helm sensor error," "actuator sensor error," "actuator-motor Hall sensor error," "actuator overload," "SW error," "steering-system communication error," "shift actuator error," "throttle actuator error," "control head error," "power supply error" and "remote-control system communication error" are allocated to error codes C001 to C011, respectively. The "helm sensor error" is a malfunction in the helm sensor 35. The "actuator sensor error" is a malfunction in the sensor provided in the steering actuator 32. The "actuator-motor Hall sensor error" is a malfunction in the motor Hall sensor provided in the steering actuator motor 32. The "actuator overload" is an overload on the motor provided in the steering actuator motor 32. The "SW error" is a malfunction in any switch used. The "steering-system communication error" is an error made in the communication unit provided in the steering ECU 31. The "shift actuator error" is a malfunction in the shift actuator 43. The "throttle actuator error" is a malfunction in the throttle actuator 42. The "control head error" is a malfunction in the control head 40. The "power supply error" is an error in the power supply of the electronic remote-control system. The "remote-control system communication error" is a malfunction in the communication unit provided in the remote control ECU 41.

How the display apparatus 1 operates will be explained below.

[Screen Switching Process]

Figure 6:
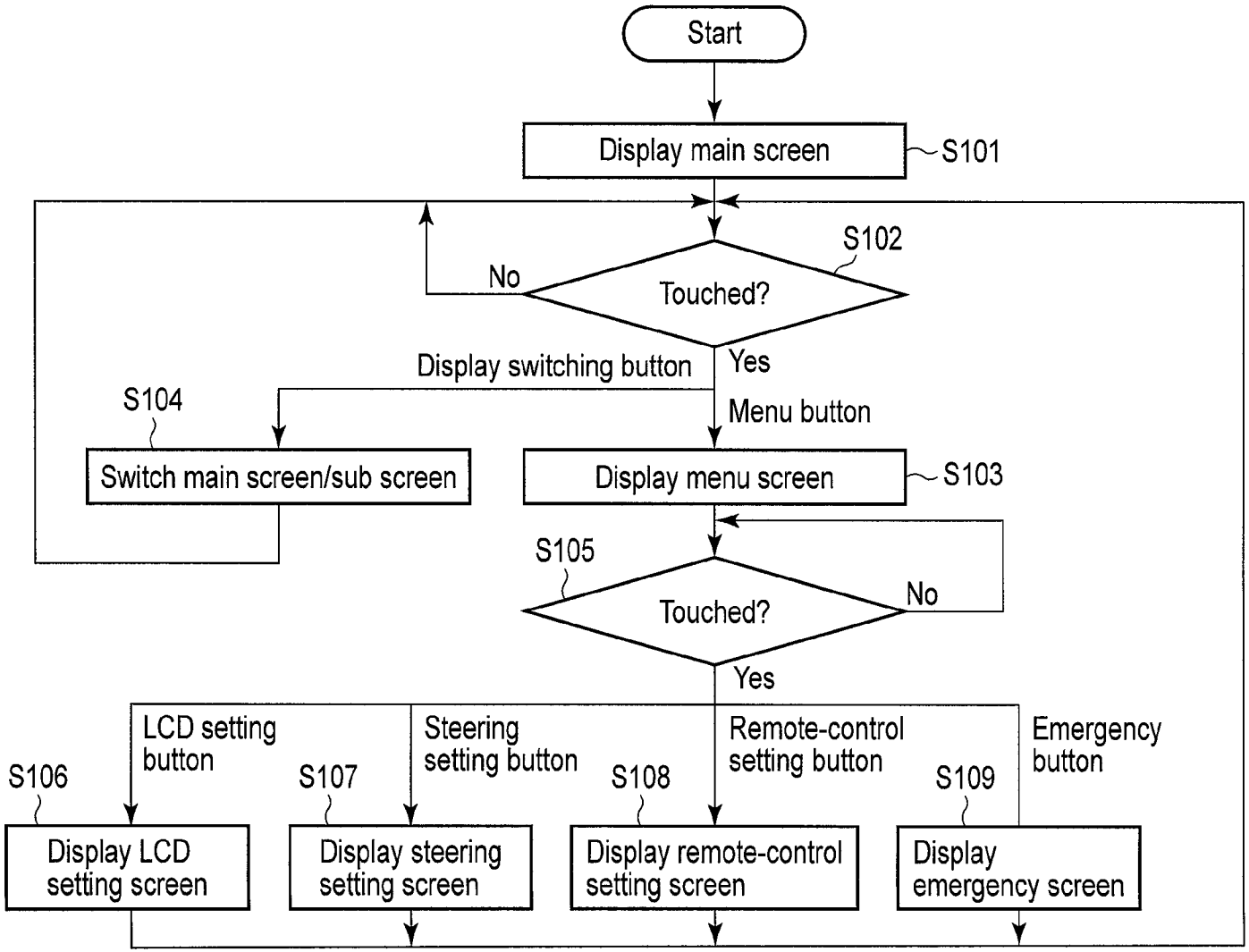
FIG. 6 is a flowchart of the screen switching process the main CPU performs for the display apparatus.

First, it will be explained how the screen displayed on the LCD 11 is switched to another in accordance with the user's instruction. If the power switch 13 is pushed, the power supply unit 105 starts supplying power to the other components. At this point, the main CPU 100 executes the computer program stored in the flash memory 102, and operates as will be described with reference to the flowchart of FIG. 6.

At first, the main CPU 100 reads the screen data representing the main screen, from the flash memory 102. The main CPU 100 controls the LCD controller 101, causing it to display, on the LCD 11, the main screen based the screen data it has read. (Step S101).

Figure 7:
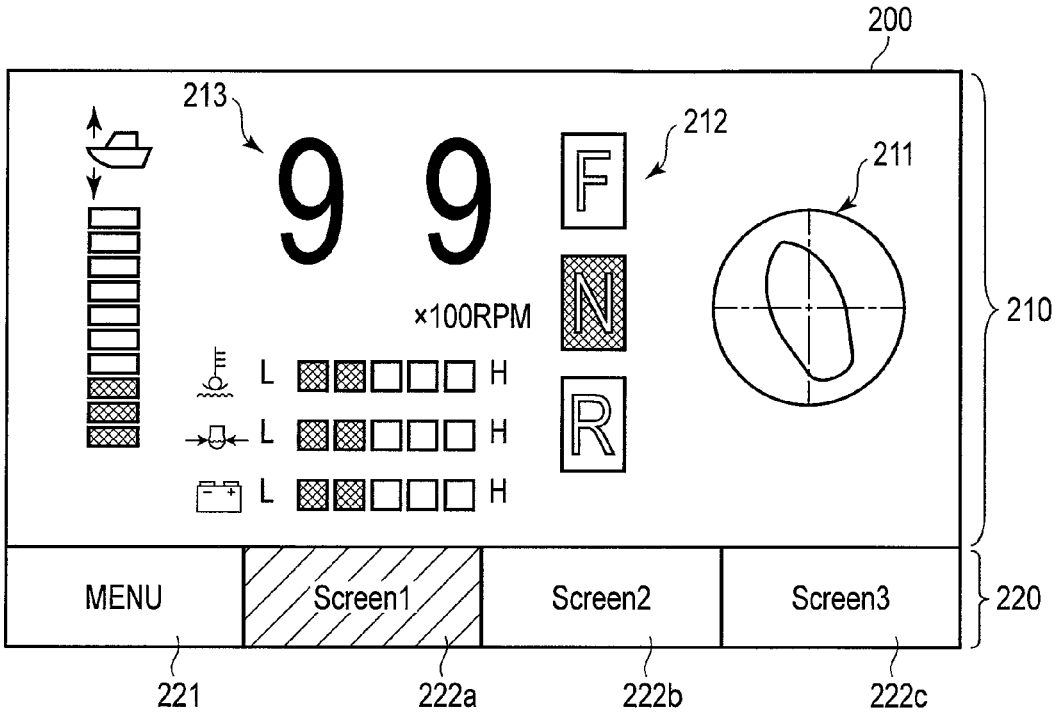
FIG. 7 is a diagram showing an exemplary main screen the display apparatus may display.

FIG. 7 shows an exemplary main screen. The main screen 200 displayed includes a meter group 210 and a button group 220. The meter group 210 shows the states of the electronic steering system and electronic remote-control system, etc. The buttons group 220 consists of GUI buttons that can be operated via touch panel 12. The meter group 210 includes a rudder angle meter 211, a shift meter 212, and a rotational speed meter 213. The rudder angle meter 211 shows the present rudder angle. The shift meter 212 shows the present shift position. The rotational speed meter 213 shows the present rotational speed of the engine 20. The button group 220 includes a menu button 221 and three display switching buttons 222*a*, 222*b* and 222*c*.

The steering ECU 31 specifies the data (present rudder angle, etc.) that should be displayed within the meter group 210, on the basis of the outputs of various sensors, and transmits the data to the display apparatus 1 in real time. The remote control ECU 41 specifies the data (present shift position, throttle opening, etc.) that should be displayed within the meter group 210, and transmits this data to the display apparatus 1 in real time. The main CPU 100 receives the data thus transmitted from the ECUs 31 and 41 via the communication device 106, and updates the data shown at the meter group 210 in real time, in accordance with the data it has received.

The display switching buttons 222*a* to 222*c* are buttons for switching the screen displayed on the LCD 11, from one to another. The display switching buttons 222*a* is allocated to the main screen 200. The display switching buttons 222*b* and 222*c* are allocated to two sub-screens, respectively, which will be described later.

After performing Step S101, the main CPU 100 waits until any button of the button group 220 displayed on the main screen 200 is touched (Step S102). If any button of the button group 220 is touched (Yes in Step S102), the main CPU 100 performs the process associated with the button operated.

Figure 8:
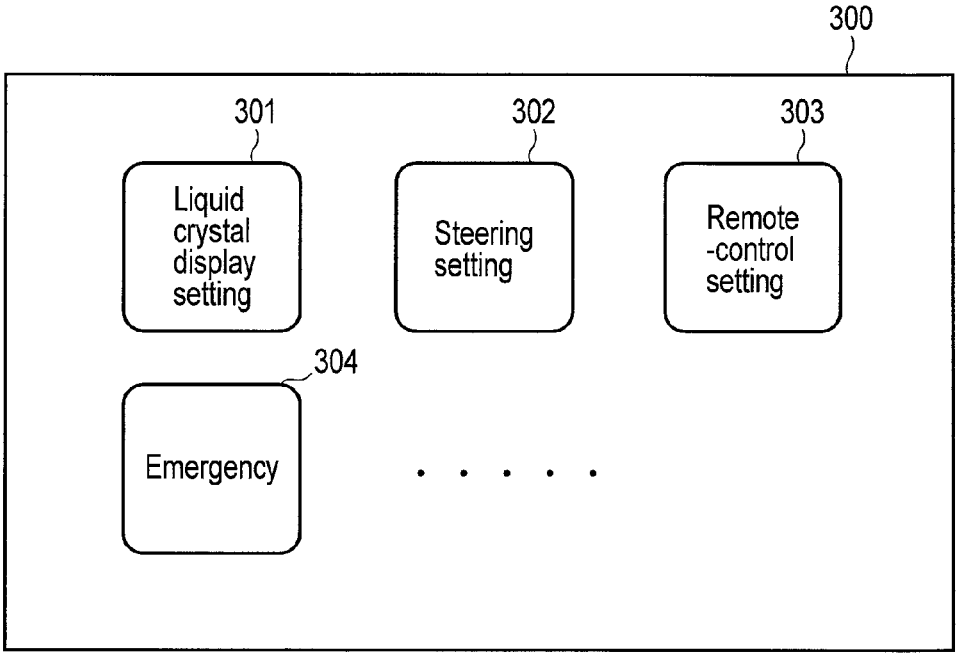
FIG. 8 is a diagram showing an exemplary menu screen the display apparatus may display.

If the menu button 221, for example, is touched, the main CPU 100 reads the data representing the menu screen, from the flash memory 102. The main CPU 100 then controls the LCD controller 101, which causes the LCD 11 to display a menu screen based on the screen data read so read (Step S103). FIG. 8 shows a menu screen 300 the display the LCD 11 may display. The menu screen 300 includes a liquid crystal display setting button 301, a steering setting button 302, a remote-control setting button 303, and an emergency button 304.

If any one of the display switching button 222*a* to 222*c* is touched, the main CPU 100 reads, from the flash memory 102, the screen data representing the screen associated with the display switching button touched. The main CPU 100 then controls the LCD controller 101, which controls the LCD 11, causing the same to display a screen based on the screen data so read (Step S104).

If the display switching buttons 222*b* or 222*c* is touched, the LCD 11 will display a sub-screen. The sub-screen includes meters not included in the meter group 210 displayed on the main screen 200, and includes other information. The sub-screens, which are displayed if the meter group 210 is touched, differ in design and types of meters constituting the meter group 210. The meter group 210 for the sub-screen can include the meters that show, for example, the amount of remaining fuel, the roll angle of the vessel, the pitch angle of the vessel, the navigation speed, and the navigating direction. After performing Step S104, the main CPU 100 returns to Step S102.

After performing Step S103, the main CPU 100 goes to Step S105. In Step S5, the main CPU 100 waits until any button of the button group displayed on the menu screen 300 is touched. If the any one of the buttons 301 to 304 is touched (Yes in Step S105), the main CPU 100 performs the process associated with the button operated.

If the liquid crystal setting button 301, for example, is touched, the main CPU 100 reads, from the flash memory 102, the data representing a liquid crystal setting screen. The main CPU 100 then controls the LCD controller 101, which controls the LCD 11, causing the same to display a liquid crystal setting screen based on the screen data so read (Step S106). The liquid crystal setting screen is a screen in which GUI buttons are configured to adjust the luminance of the backlight of the LCD 11 and the position of the display screen.

If the steering setting button 302 is touched, the main CPU 100 reads, from the flash memory 102, the screen data representing a steering setting screen. The main CPU 100 then controls the LCD controller 101, which causes the LCD 11 to display a steering setting screen based on the screen data so read (Step S107). The steering setting screen is a screen in which to designate any setting value held in the setting file 36*a* stored in the memory 36 of the steering ECU 31.

If the remote-control setting button 303 is touched, the main CPU 100 reads, from the flash memory 102, the screen data representing a remote-control setting screen. The main CPU 100 then controls the LCD controller 101, which controls the LCD, causing the same to display a remote-control setting screen based on the screen data so read (Step S108). The remote-control setting screen is a screen in which to designate any setting value held in the setting file 46*a* stored in the memory 46 remote-control ECU 41.

If the emergency button 304 is touched, the main CPU 100 reads, from the flash memory 102, the screen data representing an emergency screen. The main CPU 100 then controls the LCD controller 101, which controls the LCD, causing the same to display an emergency screen based on the screen data so read (Step S109). The emergency screen is a screen in which to drive the steering actuator 32, throttle actuator 42 and shift actuator 43, without using the helm apparatus 30 or the control head 40.

When an emergency screen 500 (see FIG. 11) is displayed, the main controller 100 notifies the start of an emergency process to the steering ECU 31 and remote control ECU 41 through the communication device 106. When the emergency screen 500 is erased, the main CPU 100 notifies the end of the emergency mode to the steering ECU 31 and remote control ECU 41 through the communication device 106. When notified of the start of the emergency mode, the steering ECU 31 prevents the helm apparatus 30 from steering the vessel until it is notified of the end of the emergency mode. When notified of the start of the emergency mode, the remote control ECU 41 prevents the control head 40 from controlling the vessel until it is notified of the end of emergency mode. When the emergency screen 500 is displayed during an emergency mode (later described), the main CPU 100 also notifies the start of the emergency mode to the steering ECU 31 and remote control ECU 41 through the communication device 106. In this case, however, the main CPU 100 notifies the end of the emergency mode to both the steering ECU 31 and the remote control ECU 41, prior to any other operations it may perform, once the malfunction that has induced the displaying of the emergency screen 500 has been eliminated. The operation of the vessel, by means of the helm apparatus 30 and control head 40, can thereby be quickly resumed from the operation of the vessel that was being performed via the emergency screen 500.

After performing Steps S106 to S109, the main CPU 100 returns to Step S102.

The configurations of the steering setting screen, remote-control setting screen and emergency screen, all mentioned above, will be described, and the processes using these screens will be explained.

[Remote-Control Setting]

Figure 9:
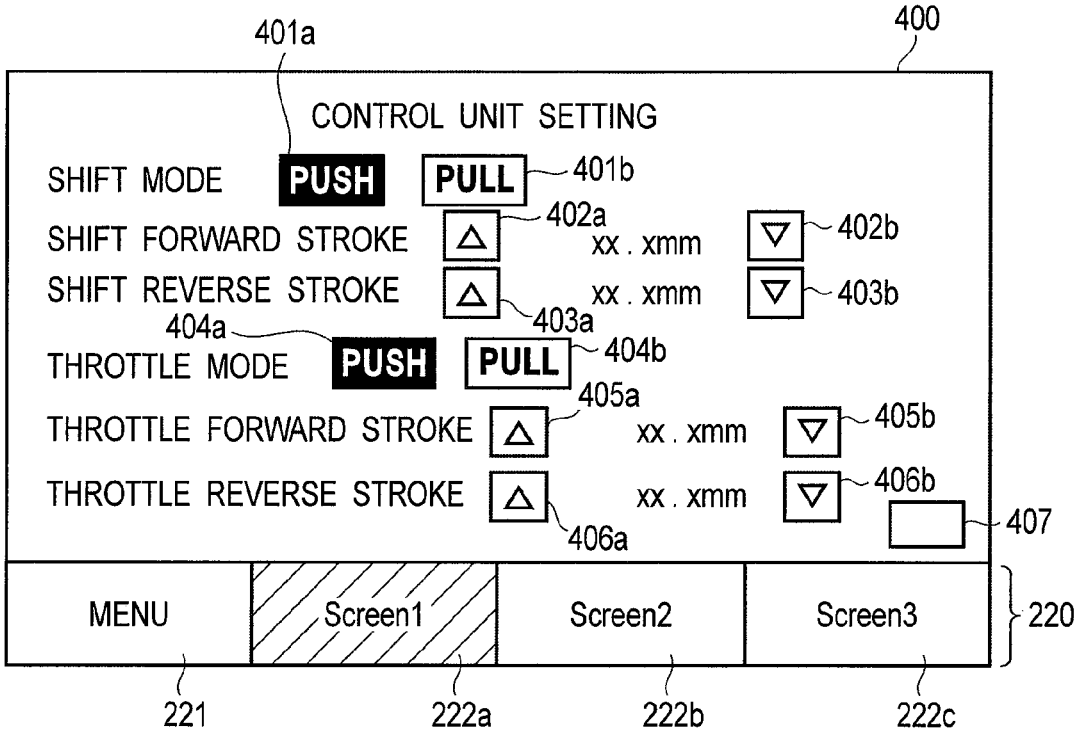
FIG. 9 is a diagram showing an exemplary remote-control setting screen the display apparatus may display.

FIG. 9 shows an exemplary remote-control setting screen 400. The remote-control setting screen 400 includes select buttons 401*a* and 401*b*, a spin buttons 402*a* and 402*b*, spin buttons 403*a* and 403*b*, select buttons 404*a* and 404*b*, spin buttons 405*a* and 405*b*, spin buttons 406*a* and 406*b*, an end button 407, and the above-mentioned buttons group 220. The select button 401*a*, 401*b* may be touched to designate the "shift mode". The spin button 402*a*, 402*b* may be touched to designate the "shift forward stroke". The spin button 403*a*, 403*b* may be touched to designate the "shift reverse stroke". The select button 404*a*, 404*b* may be touched to designate the "throttle mode". The spin button 405*a*, 405*b* may be touched to designate the "throttle forward stroke". The spin button 406*a*, 406*b* may be touched to designate the "throttle reverse stroke". The end button 407 may be touched to declare the completion of setting.

Each button included in the remote-control setting screen 400 is a GUI that can be operated by the touch panel 12. The remote-control setting screen 400 shown in FIG. 9 is the screen allocated to, for example, the display switching button 222*a*. If the display switching button 222*b* or the display switching button 222*c* is touched (Yes in Step S102), the screen allocated to the button 222*b* or 222*c* and another GUI for designating the setting values of other items held in the setting file 46*a* is displayed on the LCD 11 (Step S104).

Figure 10:
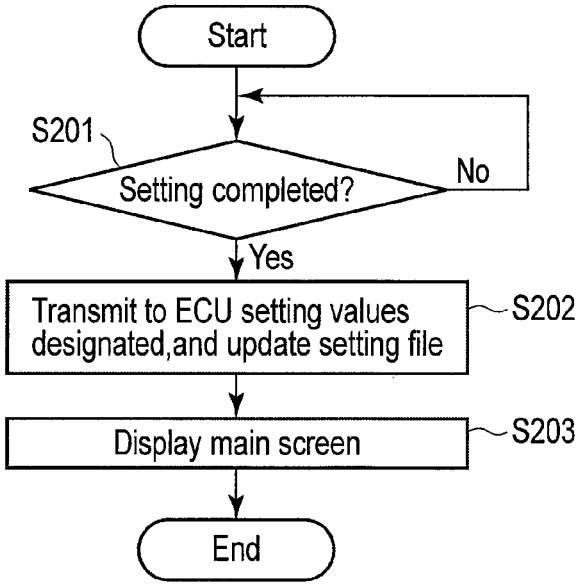
FIG. 10 is a flowchart of the setting process the main CPU may perform in the display apparatus.

FIG. 10 is a flowchart showing the setting process the main CPU 100 performs while the remote-control setting screen 400 is being displayed. This process is performed in parallel to the screen switching process described above.

In the setting process, the main CPU 100 first waits for the completion of value setting, while receiving the operation at the remote-control setting screen 400 displayed on the LCD 11 (Step S201). If the GUI designating any setting value included in the remote-control setting screen 400 is touched, the main CPU 100 changes the setting value for the item associated with the GUI touched.

Thereafter, the end button 407 displayed on the remote-control setting screen 400 may be touched (Yes in Step S201). In this case, the main CPU 100 transmits the setting values of the items designated at the remote-control setting screen 400 and a command for updating the setting file 46*a*, to the remote control ECU 41 through the communication device 106 (Step S202). When the remote control ECU 41 receives the setting values and the command, it updates the setting values held in the setting file 46*a* to the setting values received.

After performing Step S202, the main CPU 100 reads the data about the main screen 200 from the flash memory 102. The main CPU 100 then controls the LCD controller 101, which controls the LCD 11, causing the same to display the main screen 200 based on the screen data read from the flash memory 102 (Step S203). The sequence of the setting process is thus completed.

Once the setting process has been so performed, the electronic remote-control system operates in accordance with the contents of the setting file 46*a* so updated as described above.

Note that the sub-CPU 107 may write, in the EEPROM 109, the setting value for any item designated at the remote-control setting screen 400. Further, the setting value of any item so designated may be managed also in the display apparatus 1.

[Steering Setting]

The steering setting screen displayed in Step S107 is similar to the remote-control setting screen 400 shown in FIG. 9. That is, the steering setting screen also includes GUIs for designating the setting values for the items held in the setting file 36*a*, an end button 407 for declaring the completion of setting, and the above-mentioned button group 220. If the display switching button 222*b* or the display switching button 222*c* displayed at the steering setting screen is touched (Yes in Step S102), the GUI for designating the setting value for any item displayed in the steering setting screen is switched to the GUI for designating the setting value for another item (Step S104).

The main CPU 100 performs the setting process while the steering setting screen is being displayed, in the same way as shown in the flowchart of FIG. 10. That is, the main CPU 100 waits for the completion of value setting, while receiving the operation at the steering setting screen displayed on the LCD 11 (Step S201). If any GUI is touched to designate a setting value included in the steering screen, the main CPU 100 changes the setting value for the item associated with the GUI touched.

Thereafter, the end button displayed on the steering setting screen may be touched (Yes in Step S201). In this case, the main CPU 100 transmits the setting values of the items designated at the steering setting screen and a command for updating the setting file 36*a*, to the steering control ECU 31 through the communication device 106 (Step S202). When the steering control ECU 31 receives the setting values and the command, it updates the setting values held in the setting file 36*a* to the setting values received.

After performing Step S202, the main CPU 100 reads the data about the main screen 200 from the flash memory 102. The main CPU 100 then controls the LCD controller 101, which controls the LCD 11, causing the same to display the main screen 200 based on the screen data read from the flash memory 102 (Step S203). The sequence of the setting process is thus completed.

Once this setting process has been so performed, the electronic steering system operates in accordance with the contents of the setting file 36*a* so updated as described above.

The sub-CPU 107 may write, in the EEPROM 109, the setting value for any item designated at the steering setting screen. Further, the setting value of any item so designated may be managed also in the display apparatus 1.

[Emergency Mode]

Figure 11:
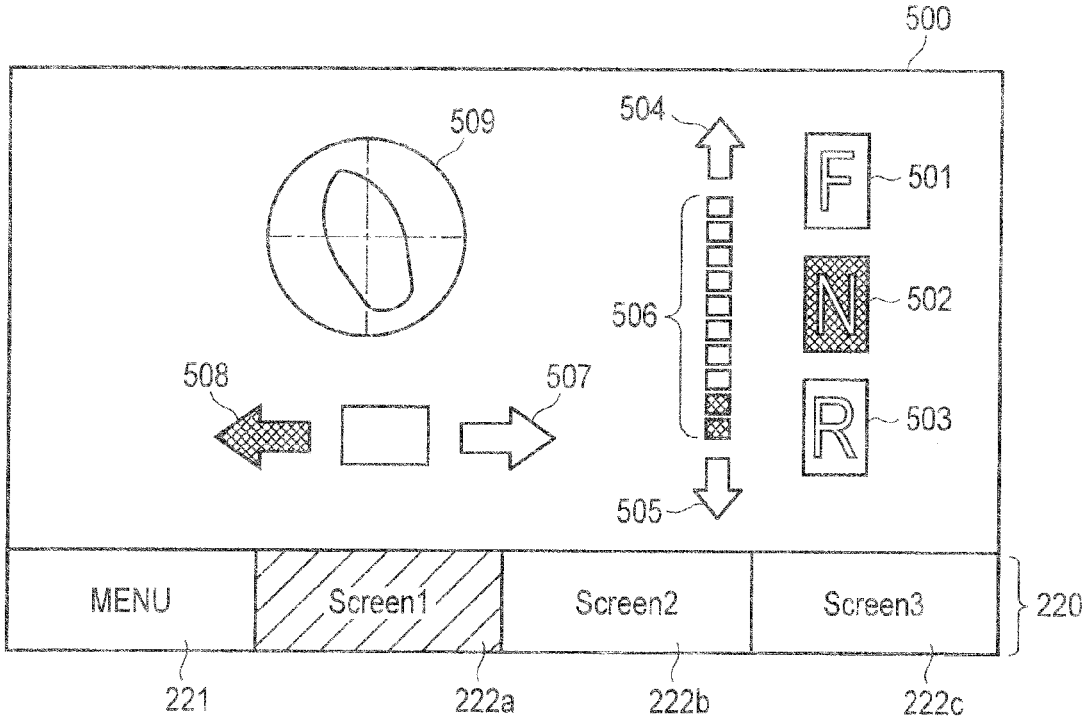
FIG. 11 is a diagram showing an exemplary emergency screen the display apparatus may display.

FIG. 11 shows an exemplary emergency screen. The emergency screen 500 shown in FIG. 11 includes a forward button 501, a neutral button 502, a reverse button 503, an up button 504, a down button 505, a throttle meter 506, a starboard-side button 507, a port-side button 508, a rudder-angle meter 509, and the above-mentioned button group 220. The forward button 501 may be touched to switch the shift mechanism 24 to the forward direction. The neutral button 502 may be touched to switch the shift mechanism 24 to the neutral side. The reverse button 503 may be touched to switch the shift mechanism 24 to the reverse direction. The up button 504 may be touched to increase the throttle opening of the throttle mechanism 21. The down button 50 may be touched to decrease the throttle opening of the throttle mechanism 21. The throttle meter 506 indicates the throttle opening of the throttle mechanism 21. The starboard-side button 507 may be touched to change the rudder angle toward starboard. The port-side button 508 may be touched to change the rudder angle toward port. The rudder-angle meter 509 indicates the rudder angle set at present.

Each button included in the emergency screen 500 is a GUI that can be operated via the touch panel 12. The emergency screen 500 of FIG. 11 is allocated to, for example, to the display switching button 222*a*. If the display switching buttons 222*b* or 222*c* is touched (Yes in Step S102), the LCD 11 will display a screen in which the buttons 501 to 504, buttons 505-508 and meters 506 and 509 are at different positions and in different designs (Step S104).

While the LCD 11 is displaying the emergency screen 500, the main CPU 100 receives a command made by any one of the buttons 501 to 508 displayed in the emergency screen 500 and then performs process associated with the button touched.

For example, any one of the forward button 501, neutral button 502 and reverse button 503 may be touched. In this case, the main CPU 100 transmits a command to the remote control ECU 41 via the communication device 106, instructing the remote control ECU to switch the shift position to the position associated with the button touched. On receiving this command, the remote control ECU 41 drives the shift actuator 43, which moves the shift mechanism 24 to the shift position designated by the command.

If up button 504 is repeatedly touched or is kept touched for some time, the main CPU 100 increases the throttle opening in accordance with the number of times the up button 504 has been touched or with the time the up button 504 has been kept touched. If the down button 505 is repeatedly touched or is kept touched for some time (i.e., long touch time), the main CPU 100 decreases the throttle opening in accordance with the number of times the up button 504 has been touched or with the time the down button 505 has been kept touched. If the throttle opening indicated by the throttle meter 506 is changed, the main CPU 100 transmits a command for adjusting the throttle opening of the throttle mechanism 21 to the value indicated by the throttle meter 506, to the remote control ECU 41 via the communication device 106. The remote control ECU 41 receives this command, and drives the throttle actuator 42. The throttle opening of the throttle mechanism 21 is thereby adjusted to the value the throttle meter 506 and indicated by the throttle meter 506.

Assume that the starboard button 507 is touched repeatedly or kept touched for some time. In this case the main CPU 100 changes the rudder angle to the starboard angle indicated by the rudder-angle meter 509, in accordance with the number of times the starboard button 507 was touched or the time the starboard button 507 has been kept touched. Also assume that the port button 508 is touched repeatedly or kept touched for some time. In this case the main CPU 100 changes the rudder angle to the port angle indicated by the rudder-angle meter 509, in accordance with the number of times the port button 508 was touched or the time the starboard-helm button 508 has been kept touched. If the rudder angle is changed to the value indicated by the rudder-angle meter 509, the main CPU 100 transmits a command to the steering ECU 31 via the communication device 106, instructing the steering ECU 31 to adjust the steering arm of the steering mechanism 25 to the rudder angle indicated by the rudder-angle meter 509. On receiving this command, the steering ECU 31 drives the steering actuator 32, which adjusts the rudder arm to the rudder angle designated by the command.

While the LCD 11 is displaying the emergency screen 500, the main controller 100 thus drives the shift actuator 43 and throttle actuator 42 in accordance with the shift position and throttle opening, both designated at the emergency screen 500. The main CPU 100 further drives the steering actuator 32 in accordance with the rudder angle designated at the emergency screen 500. Thus, the emergency screen 500 functions as spare means for driving the steering actuator 32, the throttle actuator 42 and the shift actuator 43.

[Emergency Process]

The display apparatus 1 has a function of coping with malfunction, if any, in the electronic steering system and electronic remote-control system, in addition to the function of performing the processes described above.

Figure 12:
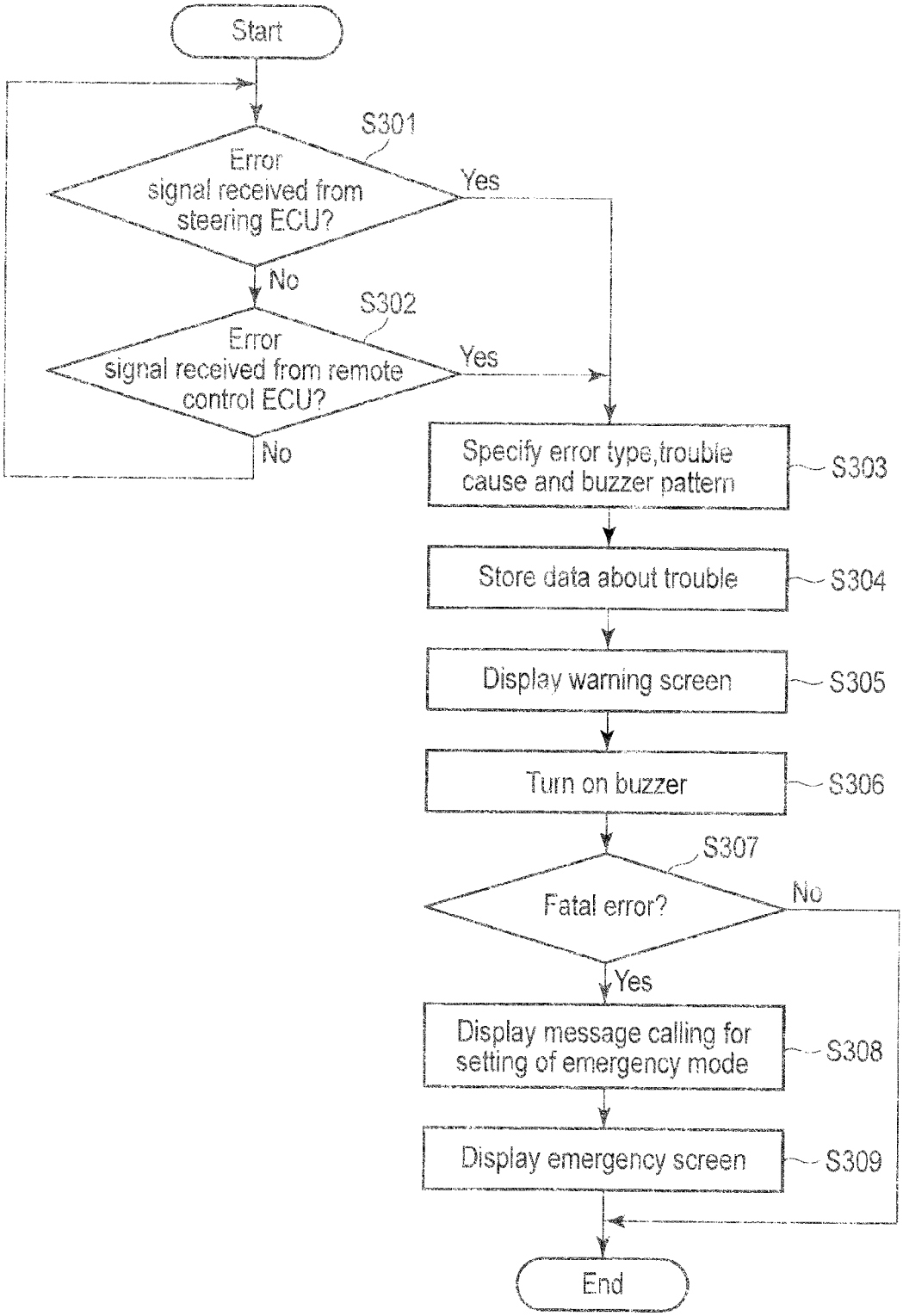
FIG. 12 is a flowchart of the emergency process the CPU may performs for the display apparatus.

To perform this function, the main CPU 100 performs the emergency process shown in the flowchart of FIG. 12. This process is performed in parallel to the screen switching process described above.

In the emergency process, the main CPU 100 first waits for any error code indicating a malfunction occurring in the helm apparatus 30 (Step S301). Then, the main CPU 100 waits for any error code indicating a malfunction occurring in the control head 40 (Step S302).

If at least one of the values output from the various sensors incorporated in, for example, the electronic steering system, is abnormal (falling outside a prescribed tolerant range), the steering ECU 31 transmits an error code to the display apparatus 1, informing the apparatus 1 of the malfunction. Similarly, if at least one of the values output from the various sensors incorporated in, for example, the electronic remote-control system, is abnormal (falling outside a prescribed tolerant range), the remote control ECU 41 transmits an error code to the display apparatus 1, informing the apparatus 1 of this malfunction.

When the communication device 106 receives an error code from the steering ECU 31 (Step S301) or from the remote control ECU 41 (Step S302), the main CPU 100 refers to the error code file 102*a*, specifying the text data about error code, the text data about cause and the buzzer pattern, all associated with the error code (Step S303).

The main CPU 100 writes the data about the malfunction (i.e., the error code, the text for the error code, the text about the cause, the date and time of malfunction, etc.) in the external memory connected to the external memory I/F 108 (Step S304). At this point, the sub-CPU 107 may write the data about the malfunction in the EEPROM 109. The data, if stored in the external memory, can serve to solve any other malfunction that may occur later or to provide various types of useful information to the user.

Figure 13:
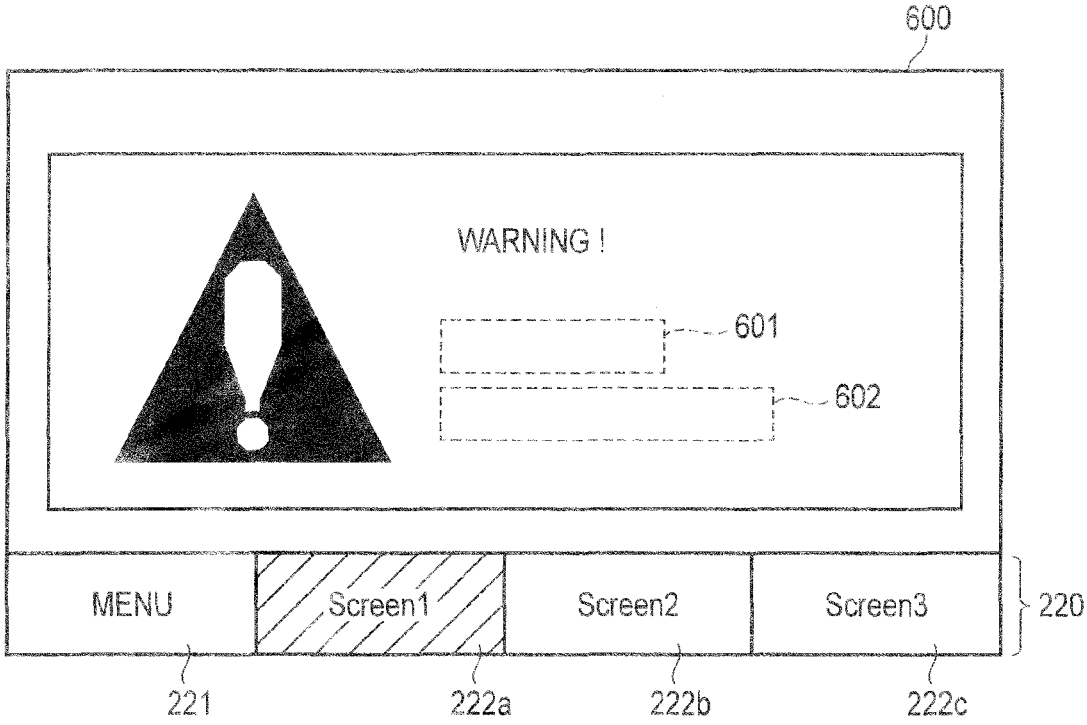
FIG. 13 is a diagram showing an exemplary warning screen the display apparatus may display.

Then, the main CPU 100 reads warning screen data from the flash memory 102. The main CPU 100 then controls the LCD controller 101, which causes the LCD 11 to display a warning screen based on the screen data read from the flash memory 102 and the text data specified in Step S303 and representing the error code and the cause (Step S305). FIG. 13 shows an exemplary warning screen. The warning screen 600 of FIG. 13 includes the error code area 601, the cause area 602, and the above-mentioned button group 220. The error code area 601 shows the text data for any malfunction, which has been specified in Step S303. The cause area 602 shows the text data for the cause, which has been specified in Step S303.

The main CPU 100 further drives the buzzer 104 in the pattern specified in Step S303, causing the buzzer 104 to generate an alarm (Step S306). Reading the data displayed on the warning screen 600 and hearing the alarm generated by the buzzer 104, the user can know the type and cause of the malfunction.

Next, the main CPU 100 determines whether the malfunction is a fatal error occurring in the helm apparatus 30 or in the control head 40 (Step S307). The "fatal error" means a malfunction jeopardizes the normal steering, such as the "helm sensor malfunction" or the "control head malfunction," both held in the error code file 102*a*.

In order to enable main CPU 100 to make a decision in Step S307, the file holding the error code of the above-mentioned fatal error is stored beforehand in the ROM that is incorporated in the main CPU 100. If this file holds the error code received in Step S301 or Step S302, the main CPU 100 determines that a fatal error has occurred.

To make the sub-CPU 107 perform the process of Step S307, a file holding the error code of the fatal error is stored beforehand in the ROM incorporated in the sub-CPU 107. If the file holds the error code received in Step S301 or Step S302, the sub-CPU 107 determines that a fatal error has occurred.

If the main CPU 100 determines in Step S307 that the malfunction is a fatal error (Yes in Step S307), it controls the LCD controller 101, which causes the LCD 11 to display the emergency screen 500, prompting the user to steer the vessel via emergency screen 500 (Step S308).

Thereafter, the main CPU 100 reads the screen data representing the emergency screen 500, from the flash memory 102. The main CPU 100 controls the LCD controller 101, which causes the LCD 11 to display the emergency screen 500 based on the screen data read from the flash memory 102 (Step S309). The user can therefore use the emergency screen 500 to steer the vessel, without the necessity of selecting the emergency screen 500 at the menu screen 300.

When Step S309 is performed, the sequence of the emergency process is completed. If it is determined in Step S307 that no fatal error have occurred, the emergency process will be completed, not performing Step S308 or Step S309.

As explained above, the display apparatus 1 according to this embodiment displays the main screen 200 including the shift position and throttle opening, both designated as the control head 40 is operated, and also including the rudder angle designated as the helm apparatus 30. Moreover, the display apparatus 1 displays the warning screen 600, informing the user of the types and causes of malfunctions, if any the electronic steering system and electronic steering system.

Reading the data displayed on the warning screen 600, the user can very easily learn the operating states of the electronic steering system and electronic steering system. Further, the user can know the type and cause of any malfunction occurring in either system, without referring to the manual available.

The display apparatus 1 further displays, on the LCD 11, the remote-control setting screen 400 at which the user can designate the setting values for the electronic remote-control system or the steering setting screen at which the user can designate the setting values for the electronic steering system. In accordance with the setting values designated on these setting screens, the display apparatus 1 changes the setting of the electronic remote-control system and the setting of the electronic steering system. On these respective setting screens, the setting of these systems can be accomplished quite easily.

If a malfunction occurs in the control head 40 or the helm apparatus 30, the display apparatus 1 displays the emergency screen 500 on the LCD 11. The display apparatus 1 further drives the shift actuator 43, throttle actuator 42 and steering actuator 32, in accordance with, respectively, the shift position, throttle opening and rudder angle designated at the emergency screen 500. So configured, the display apparatus 1 enables the user to steer the vessel as usual, even if the control head 40 or the helm apparatus 30 fails to function.

Thanks to its configuration, the embodiment can achieve various advantages other than those described above.

The configuration of the embodiment can be modified in various manners.

For example the embodiment described above, which is designed for use in a vessel having one outboard engine, can be modified for use in a vessel having a plurality of outboard engines.

The propulsion device, which is controlled by the electronic remote-control system or the electronic steering system, is not limited to the outboard engine. The propulsion device may be an inboard engine.

Further, the items set in the setting process performed for the electronic remote-control system or electronic steering system may include items other than those exemplified in FIG. 2 and FIG. 3.

Still further, the error code notified in the emergency process may include some other than those exemplified in FIG. 5. For example, the types of malfunctions that may occur in the outboard engine may be notified in the emergency mode, too.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display apparatus for use in a vessel, the display apparatus comprising:

a display;

an interface configured to manipulate a screen displayed on the display;

a communication device which is configured to perform communication with a remote control system including a control head configured to designate a shift position of a shift mechanism of a propulsion device provided in the vessel and a throttle opening of a throttle mechanism of the propulsion device, a shift actuator configured to drive the shift mechanism in accordance with the shift position designated by the control head, and a throttle actuator configured to drive the throttle mechanism in accordance with the throttle opening designated by the control head, and which is configured to receive at least one of the shift position designated by the control head, the throttle opening designated by the control head and ID data indicating any malfunction in the remote control system; and a controller configured to cause the display to display the shift position the communication device has received, the throttle opening the communication device has received or a type of the malfunction or a cause of the malfunction indicated by the ID data, wherein the controller causes the display to display an emergency screen at which to designate the shift position and the throttle opening, when a malfunction occurs in the control head, and communicate with the remote control system via the communication device, thereby to drive the shift actuator and throttle actuator in accordance with the shift position and throttle opening designated at the emergency screen by operating the interface at the emergency screen.

2. The display apparatus according to claim 1, wherein:

the communication device further communicates with a steering system including a helm apparatus configured to designate a rudder angle of the propulsion device and a steering actuator configured to drive a steering mechanism in accordance with the rudder angle designated by the helm apparatus, thereby to change the rudder angle of the propulsion unit, and receives at least one of the rudder angle designated by the helm apparatus and ID data indicating a malfunction occurring in the steering system; and the controller causes the display to display the rudder angle the communication device has received from the steering system, or a type or a cause of the malfunction, indicated by the ID data the communication device has received from the steering system.

3. The display apparatus according to claim 1, wherein the controller causes the display to display a setting screen at which to designate setting values for operating the remote control system, and communicates with the remote control system via the communication device, thereby to change the setting of the remote control system in accordance with the setting values designated by operating the interface at the setting screen.

4. The display apparatus according to claim 3, wherein the interface is a touch panel configured to detect any touch on the display screen of the display.

5. The display apparatus according to claim 2, wherein the controller causes the display to display a setting screen at which to designate setting values for the remote control system and the steering system, communicates with the remote control system and steering system via the communication device, thereby to change the setting of the remote control system in accordance with the setting values designated by operating the interface at the setting screen and to change the setting of the steering system in accordance with the setting values designated by operating the interface at the setting screen.

6. The display apparatus according to claim 5, wherein the controller causes the display to display the emergency screen at which to designate the shift position and the throttle opening, and at which to further designate the rudder angle, when a malfunction occurs in the control head or the helm apparatus, and communicate with the remote control system and the steering system via the communication device, thereby to drive the shift actuator and the throttle actuator in accordance with the shift position and the throttle opening designated by operating the interface at the emergency screen and to drive the steering actuator in accordance with the rudder angle designated by operating the interface at the emergency screen.

7. The display apparatus according to claim 5, wherein the interface is a touch panel configured to detect any touch on the display screen of the display.

8. A display apparatus for use in a vessel, the display apparatus comprising:

a display;

an interface configured to manipulate a screen displayed on the display, a communication device which is configured to perform communication with a remote control system including a control head configured to designate a shift position of a shift mechanism of a propulsion device provided in the vessel and a throttle opening of a throttle mechanism of the propulsion device, a shift actuator configured to drive the shift mechanism in accordance with the shift position designated by the control head, and a throttle actuator configured to drive the throttle mechanism in accordance with the throttle opening designated by the control head; and a controller configured to cause the display to display a setting screen at which to designate setting values for operating the remote control system, and to communicate with the remote control system via the communication device, thereby to change the setting of the remote control system in accordance with the setting values designated by operating the interface at the setting screen, wherein the controller is configured to cause the display to display an emergency screen at which to designate the shift position and the throttle opening, when a malfunction occurs in the control head, and to communicate with the remote control system via the communication device, thereby to drive the shift actuator and the throttle actuator in accordance with the shift position and the throttle opening designated at the emergency screen by operating the interface at the emergency screen.

9. The display apparatus according to claim 8, wherein the interface is a touch panel configured to detect any touch on the display screen of the display.

10. A display apparatus for use in a vessel, the display apparatus comprising:

a display;

an interface configured to manipulate a screen displayed on the display, a communication device configured to communicate with a remote control system including a control head configured to designate a shift position of a shift mechanism of a propulsion device provided in the vessel and a throttle opening of a throttle mechanism of the propulsion device, a shift actuator configured to drive the shift mechanism in accordance with the shift position designated by the control head, and a throttle actuator configured to drive the throttle mechanism in accordance with the throttle opening designated by the control head; and a controller configured to cause the display to display an emergency screen at which to designate the shift position and the throttle opening, when a malfunction occurs in the control head, and to communicate with the remote control system via the communication device, thereby to drive the shift actuator and the throttle actuator in accordance with the shift position and the throttle opening designated at the emergency screen by operating the interface at the emergency screen.

11. The display apparatus according to claim 10, wherein the interface is a touch panel configured to detect any touch on the display screen of the display.

12. A display apparatus for use in a vessel, the display apparatus comprising:

a display;

an interface configured to manipulate a screen displayed on the display;

a communication device configured to communicate with a steering system including a helm apparatus configured to designate a rudder angle of a propulsion device provided in vessel and a steering actuator configured to drive a steering mechanism in accordance with the rudder angle designated by the helm apparatus, thereby to change the rudder angle of the propulsion device, and configured to receive at least one of the rudder angle designated by the helm apparatus and the ID data indicating a malfunction occurring in the steering system; and a controller configured to cause the display to display the rudder angle the communication device has received or a cause or a type of the malfunction indicated by the ID data the communication device has received, wherein the controller is configured to cause the display to display an emergency screen when a malfunction occurs in the helm apparatus, and to communicate with the steering system via the communication device, thereby to drive the steering actuator in accordance with the rudder angle designated by operating the interface at the emergency screen.

13. A display apparatus for use in a vessel, the display apparatus comprising:

a display;

an interface configured to manipulate a screen displayed on the display, a communication device configured to communicate with a steering system including a helm apparatus configured to designate a rudder angle of a propulsion device provided in the vessel and a steering actuator configured to drive a steering mechanism in accordance with the rudder angle designated by the helm apparatus, thereby to change the rudder angle of the propulsion device; and a controller configured to cause the display to display a setting screen at which to designate setting values for operating the steering system, and to communicate with the steering system via the communication device, thereby to change the setting of the steering system in accordance with the setting values designated by operating the interface at the setting screen, wherein the controller is configured to cause the display to display an emergency screen when a malfunction occurs in the helm apparatus, and to communicate with the steering system via the communication device, thereby to drive the steering actuator in accordance with the rudder angle designated by operating the interface at the emergency screen.

14. The display apparatus according to claim 13, wherein the interface is a touch panel configured to detect any touch on the display screen of the display.

15. A display apparatus for use in a vessel, the display apparatus comprising:

a display;

an interface configured to manipulate a screen displayed on the display, a communication device configured to communicate with a steering system including a helm apparatus configured to designate a rudder angle of a propulsion device provided in the vessel and a steering actuator configured to drive a steering mechanism in accordance with the rudder angle designated by the helm apparatus, thereby to change the rudder angle of the propulsion device; and a controller configured to cause the display to display an emergency screen when a malfunction occurs in the helm apparatus, and to communicate with the steering system via the communication device, thereby to drive the steering actuator in accordance with the rudder angle designated by operating the interface at the emergency screen.

16. The display apparatus according to claim 15, wherein the interface is a touch panel configured to detect any touch on the display screen of the display.

* * * * *